US009902154B2

(12) United States Patent
Miyakoshi et al.

(10) Patent No.: US 9,902,154 B2
(45) Date of Patent: Feb. 27, 2018

(54) IMAGE PRINTING APPARATUS

(71) Applicant: CANON KABUSHIKI KAISHA, Tokyo (JP)

(72) Inventors: Arihito Miyakoshi, Tokyo (JP); Masahiko Kubota, Tokyo (JP); Yusuke Imahashi, Kawasaki (JP); Nobuhito Yamaguchi, Inagi (JP); Hiroshi Arimizu, Kawasaki (JP); Yoshinori Itoh, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/453,745

(22) Filed: Mar. 8, 2017

(65) Prior Publication Data

US 2017/0259571 A1 Sep. 14, 2017

(30) Foreign Application Priority Data

Mar. 11, 2016 (JP) ..... 2016-048861

(51) Int. Cl.

| | |
|---|---|
| ***B41J 11/02*** | (2006.01) |
| ***B41J 2/165*** | (2006.01) |
| ***B41J 11/00*** | (2006.01) |

(52) U.S. Cl.

CPC ..... *B41J 2/165* (2013.01); *B41J 11/0085* (2013.01); *B41J 11/02* (2013.01)

(58) Field of Classification Search

CPC ..... B41J 11/0085; B41J 11/0065; B41J 11/02; B41J 2/1714; B41J 11/057; B41J 2/1721; B41J 2002/1742; B41J 2/01

See application file for complete search history.

(56) References Cited

U.S. PATENT DOCUMENTS

| | | | | |
|---|---|---|---|---|
| 8,646,902 | B2 * | 2/2014 | Toyoshima | B41J 11/0085 347/101 |
| 9,205,656 | B2 * | 12/2015 | Wada | B41J 2/1721 |
| 2006/0262174 | A1 * | 11/2006 | Aoai | B41C 1/1066 347/100 |
| 2007/0291096 | A1 * | 12/2007 | Toyoshima | B41J 11/0025 347/104 |
| 2017/0087884 | A1 * | 3/2017 | Wada | B41J 11/0085 |

FOREIGN PATENT DOCUMENTS

| | | |
|---|---|---|
| JP | 2006-21475 A | 1/2006 |
| JP | 2010-17895 A | 1/2010 |
| JP | 2015-166166 A | 9/2015 |

* cited by examiner

*Primary Examiner* — Huan Tran

(74) *Attorney, Agent, or Firm* — Canon U.S.A., Inc. IP Division

(57) ABSTRACT

A platen disposed so as to face a printing head includes a third support portion. A second suction hole is formed in an area through which a recording medium passes at least beyond the third support portion in the width direction of the recording medium or downstream of the third support portion in the conveyance direction. A supply port is formed between the third support portion and the second suction hole. Air is sucked into the second suction hole and supplied toward the recording medium through the supply port.

12 Claims, 7 Drawing Sheets

IMAGE PRINTING APPARATUS

BACKGROUND

Field of the Disclosure

The present disclosure relates to an ink-jet image printing apparatus including a platen supporting a recording medium.

Description of the Related Art

Japanese Patent Laid-Open No. 2006-21475 discloses an ink-jet printing apparatus that forms an image on a sheet without a margin at the edge of the sheet, that is, enables so-called "marginless printing". This apparatus uses a suction platen that sucks air from a suction hole to cause the sheet to adhere to the platen.

According to Japanese Patent Laid-Open No. 2006-21475, when marginless printing is performed on the trailing end of the sheet, the sheet adheres to the adherence portion of the platen. However, when marginless printing is performed on the leading end of the sheet, the leading end of the sheet has not reach the adherence portion, and the sheet has not adhered to the adherence portion. Accordingly, the leading end of the sheet rises when the sheet is fed to the platen, and an ink is applied to the sheet with part of the sheet rising. Consequently, it is thought that the quality of an image on the rising part may decrease and that the sheet may be stained due to contact of the sheet with a head. In addition, there is a technical problem in that in some cases of marginless printing, an ink ejected to beyond the edge of the sheet becomes an ink mist, which floats and may adhere to the back surface of the sheet.

SUMMARY

The present disclosure provides an image printing apparatus including a printing head that ejects an ink to perform printing, a platen that supports a recording medium at a position at which the platen faces the printing head, an ink receiving portion that is formed on the platen and receives the ink ejected to beyond an edge of the recording medium during printing, a first support portion that is disposed on the platen upstream of the ink receiving portion in a conveyance direction of the recording medium and supports the recording medium, a second support portion that is disposed on the platen downstream of the ink receiving portion in the conveyance direction and supports the recording medium, and a third support portion that is disposed on the platen near an edge of the recording medium in a width direction of the recording medium in an area through which the recording medium passes. The third support portion includes a contact portion that protrudes from the ink receiving portion and comes into contact with the recording medium, a non-contact portion that is surrounded by the contact portion and does not come into contact with the recording medium, and a first suction hole formed in the non-contact portion, and air is sucked into the first suction hole to cause the recording medium to adhere to the contact portion. The ink receiving portion has a second suction hole formed in the area through which the recording medium passes at least beyond the third support portion in the width direction or downstream of the third support portion in the conveyance direction and a supply port formed between the third support portion and the second suction hole, and air is sucked into the second suction hole and supplied toward the recording medium through the supply port.

Further features of the present disclosure will become apparent from the following description of exemplary embodiments with reference to the attached drawings.

DESCRIPTION OF THE EMBODIMENTS

An image printing apparatus according to an embodiment of the present disclosure will be described. In the embodiment, components are described by way of example and do not limit the range of the present disclosure. In the following description, a serial type ink-jet printing apparatus is taken as an example. A serial type ink-jet printing apparatus performs printing in a manner in which a head for ejecting an ink reciprocates in a direction intersecting the conveyance direction of sheets with respect to the sheets intermittently conveyed in the conveyance direction. However, the present disclosure is not limited to a serial type printing apparatus and can be applied to a line type printing apparatus that uses an elongated head to perform printing. The present disclosure is not limited to an ink-jet printing apparatus and can also be applied to a multifunction printing apparatus having, for example, a copy function and a facsimile function. In the description, a sheet means a sheet-like printing medium such as paper, plastic, or fabric, and an image is formed on the sheet by using the image printing apparatus. The sheet is not limited to a cut sheet and may be a rolled sheet. In the description, the term "cover" means that an object covers another one located below the object such that the other one is invisible and does not include the meaning of blocking an air flow.

First Embodiment

Outline of Apparatus

Figure 1:
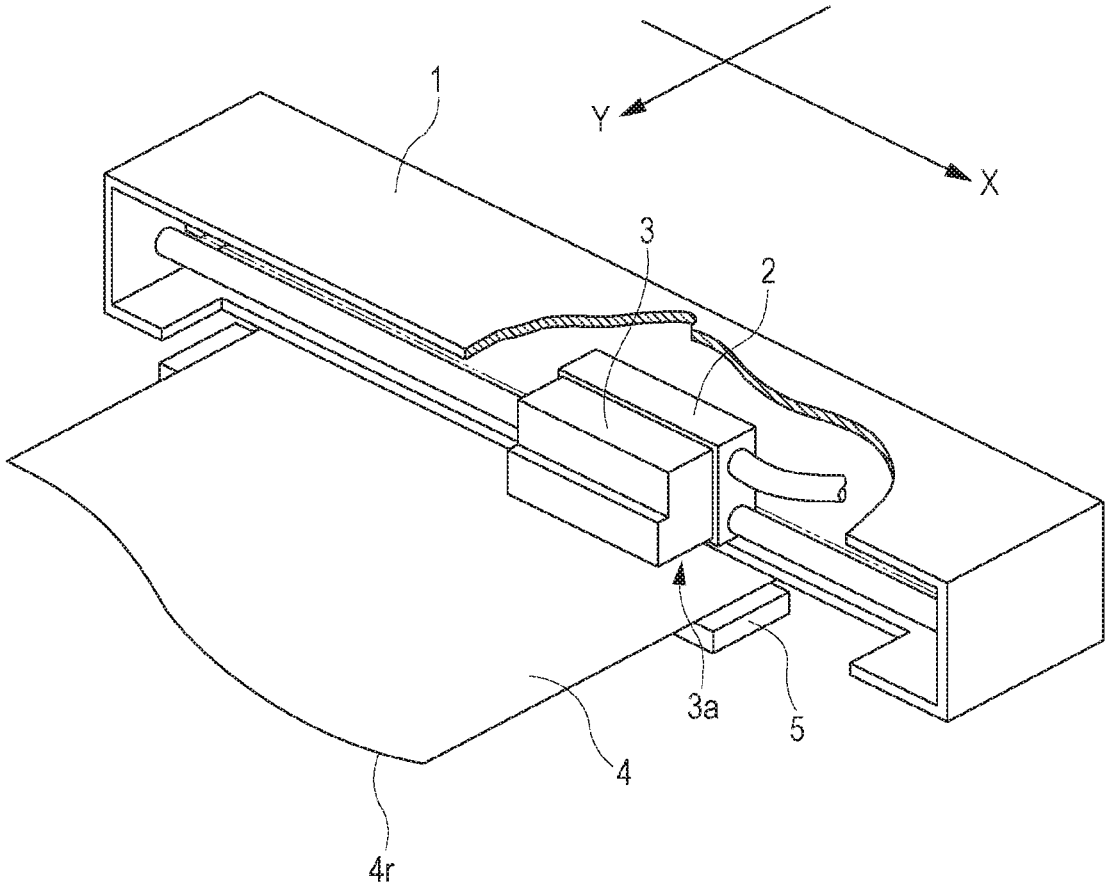
FIG. 1 is a perspective view of an image printing apparatus according to one or more aspects of the present disclosure and schematically illustrates its internal structure.

FIG. 1 is a perspective view of an image printing apparatus 1 according to a first embodiment and schematically illustrates its internal structure. In the image printing apparatus 1, a printing head 3 (referred to as a head 3 below) that ejects an ink reciprocates in a main scan direction (X-direction in the figure) together with a carriage 2, and droplets of the ink (ink droplets) are ejected to a cut sheet 4 (referred to as a sheet 4 below) to print an image. A sheet-conveying mechanism (not illustrated) intermittently conveys the sheets 4 in a direction intersecting the X-direction (Y-direction perpendicular to the X-direction in the embodiment). The image printing apparatus 1 repeats the reciprocating motion of the head 3 in the X-direction and the intermittent conveyance motion of each sheet 4 in the Y-direction to print an image on a surface (print surface) of the sheet 4. The image printing apparatus 1 includes a platen 5 that supports the sheet 4 conveyed by the sheet-conveying mechanism (not illustrated) from the back surface (surface opposite to the print surface) of the sheet 4. In the following description, the movement of the carriage 2 and the head 3 in the X-direction is also referred to as a main scan. The X-direction corresponds to the direction in which the carriage 2 moves and the width direction of the sheet 4 to be conveyed. Accordingly, the X-direction is also referred to as the main scan direction or a sheet width direction. The Y-direction is also referred to as a sheet conveyance direction.

As illustrated in FIG. 1, the platen 5 extends in the sheet width direction and is disposed so as to face the ejection-port surface 3*a* of the head 3 on which ejection ports through which an ink is ejected are arranged. The platen 5 supports the sheet 4 conveyed by the sheet-conveying mechanism (not illustrated) from the back surface 4*r* of the sheet. The platen 5 includes suction support portions 6 in order to maintain an appropriate distance (distance between the sheet and the head) between the ejection-port surface 3*a* and the sheet 4, and the suction support portions 6 support the sheet from the back surface 4*r* while inhibiting the sheet 4 from rising or bending.

Structure of Platen

Figure 2:
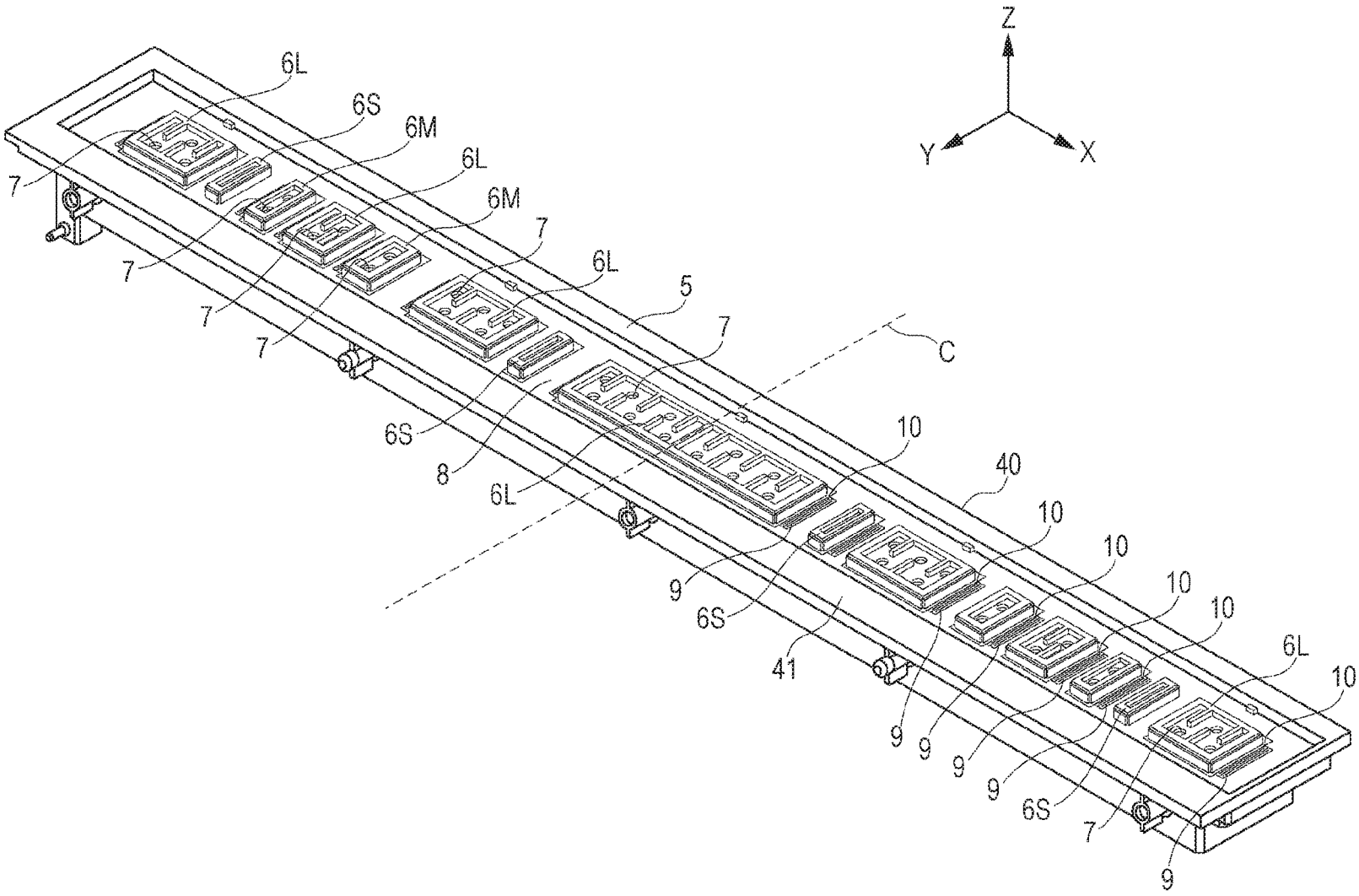
FIG. 2 is a perspective view of a platen according to one or more aspects of the present disclosure.

FIG. 2 is a perspective view of the platen 5. The platen 5 includes an ink receiving portion 8 that receives the ink ejected from the head 3. In the image printing apparatus 1, when printing is performed on the sheet 4 without a margin at the edge of the sheet 4, that is, when marginless printing is performed, the ink is ejected to beyond the edge of the sheet 4. In the image printing apparatus 1, an ink is also ejected to beyond the sheet 4 right before printing, that is, auxiliary ejection is performed to stabilize the ink ejecting performance of the head 3. The ink receiving portion 8 receives the ink ejected from the head 3 to beyond the sheet 4. An ink absorber (for example, a porous sheet material such as urethane foam) that absorbs the ejected ink may be disposed on a surface of the ink receiving portion 8. The ink absorber disposed on the ink receiving portion 8 inhibits the ink ejected to beyond the sheet 4 from splashing back or leaking. The ink receiving portion 8 does not necessarily need to receive the ink on the surface thereof but may include a portion on which the ink is not ejected and is not received.

The platen 5 includes an upstream support portion 40 (first support portion) upstream of the ink receiving portion 8 in the sheet conveyance direction and a downstream support portion 41 (second support portion) downstream of the ink receiving portion 8 in the sheet conveyance direction (See FIG. 2). The upstream support portion 40 and the downstream support portion 41 extend in the sheet width direction. The platen 5 supports each sheet 4 on the upstream support portion 40 and on the downstream support portion 41. The ink receiving portion 8 is formed so as to be lower than the upstream support portion 40 and the downstream support portion 41 in the vertical direction (Z-direction). Accordingly, the ink receiving portion 8 does not come into contact with the sheet 4.

The suction support portions 6 (third support portions) are arranged on the ink receiving portion 8 in the sheet width direction. The suction support portions 6 protrude upward from the ink receiving portion 8 in the vertical direction and are rectangular in the embodiment. Each of the suction support portions 6 includes a contact portion 6*a* that is to support the sheet 4 together with the upstream support portion 40 and the downstream support portion 41 and a non-contact portion 6*b* that does not come into contact with the sheet 4 as illustrated in FIGS. 3A to 3F. The contact portion 6*a* is formed in a rectangular frame shape with a width of several millimeters when viewed from above and forms a support surface for the sheet 4 together with the upstream support portion 40 and the downstream support portion 41. The non-contact portion 6*b* is surrounded by the contact portion 6*a* and is lower than the contact portion 6*a* in the vertical direction. The shape of each suction support portion 6 is not limited to a rectangular shape and may be another shape.

As illustrated in FIG. 2, the suction support portions 6 on the ink receiving portion 8 are divided into three types having different sizes and different structures in order to support sheets having different widths. Among the three types of the suction support portions 6, suction support portions 6L have the longest length in the sheet width direction, and first suction holes 7 are formed in the non-contact portion 6*b* of each suction support portion 6L. The first suction holes 7 are in communication with a negative-pressure generating member (not illustrated) such as a fan or a pump, which is an air suction source, disposed below the platen 5 in the vertical direction. A negative pressure is applied to a space between the non-contact portion 6*b* and the sheet 4 in a manner in which air is sucked into the first suction holes 7, and the sheet 4 can thereby be caused to adhere to the contact portion 6*a*. As illustrated in FIGS. 3A to 3F, intermediate ribs 6*r* are formed in the non-contact portion 6*b* of each suction support portion 6L. The intermediate ribs 6*r* each have the same height in the vertical direction as the contact portion 6*a* and extend in the sheet conveyance direction. The intermediate ribs 6*r* and the contact portion 6*a* support the sheet 4 in an auxiliary manner and thereby inhibit the sheet 4 from being locally depressed into the non-contact portion 6*b* due to air being sucked into the first suction holes 7. The number of the first suction holes 7, the diameter of the first suction holes 7, and the number of the intermediate ribs 6*r* may be determined appropriately in accordance with the size of the non-contact portion 6*b*, the stiffness of the corresponding sheet, or air suction force. The suction support portion including the first suction holes 7 and the intermediate ribs 6*r* in the non-contact portion 6*b* is referred to as the suction support portion 6L.

Suction support portions 6M have the second-longest length in the sheet width direction after the suction support portions 6L, and the first suction holes 7 are formed in the non-contact portion 6*b* of each suction support portion 6M. There are no intermediate ribs 6*r* in each suction support portion 6M. Accordingly, the suction support portion including the first suction holes 7 in the non-contact portion 6*b* and including no intermediate ribs 6*r* in the non-contact portion 6*b* is referred to as the suction support portion 6M.

Suction support portions 6S have the shortest length in the sheet width direction among the three types, and there are no first suction holes 7 nor intermediate ribs 6*r* in the non-contact portion 6*b* of each suction support portion 6S. The suction support portion including no first suction holes 7 nor intermediate ribs 6*r* in the non-contact portion 6*b* is referred to as the suction support portion 6S. In the description, the combination of the suction support portions 6L, 6M, and 6S is referred to as the suction support portions 6. The suction support portions 6 have different lengths in the sheet width direction depending on their type but have the same length in the sheet conveyance direction regardless of their type.

The arrangement of the suction support portions 6 is determined in accordance with a standard for a printing position. In the embodiment, the standard for a printing position is set to the center of the sheet 4 in the width direction for sheet supply, and this is referred to as a center standard. In the case of supplying the sheets 4 having different widths according to the center standard, the sheets 4 are conveyed such that the center of the width (print width) of the sheets 4 passes through the same position. In order to enable such sheet supply according to the center standard, different types of the suction support portions 6 are arranged on the platen 5 so as to be bilaterally symmetric in a state where the central position C in the sheet width direction of an area through which each sheet 4 passes is regarded as the standard (See FIG. 2). The suction support portions 6 are also arranged so as not to locate within the range of about 2 mm from the edge of sheets having different standard sizes when the sheets are conveyed. The arrangement and shape of the suction support portions 6 of the platen 5 are determined so as to correspond to the width of the sheets 4 such as L, KG, 2L, 203 mm×254 mm, Letter, A4, 254 mm×305 mm, A3, enlarging A3, 356 mm×432 mm, A2, enlarging A2, and 17 inches. Instead of the center standard, the suction support portions 6 may be arranged according to a one-side standard, where the sheets 4 having different widths are lined up on the basis of a left standard position or a right standard position.

Figure 3A:
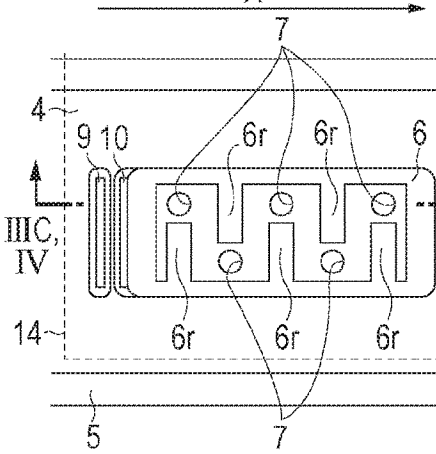
FIGS. 3A to 3F are schematic views of a suction support portion according to one or more aspects of the present disclosure and the vicinity thereof.

FIGS. 3A to 3F are enlarged views of one of the suction support portions 6 and the vicinity thereof. FIG. 3A is a top view thereof. FIGS. 3A to 3F illustrate one of the suction support portions 6L by way of example. In particular, FIGS. 3A to 3F each illustrate a state where the sheet 4 is conveyed to the printing position when an image is printed on the leading end portion 15 and one of the side edge portions 14 of the sheet 4. The suction support portion 6L illustrated by way of example includes five first suction holes 7 and five intermediate ribs 6*r*.

Figure 3B:
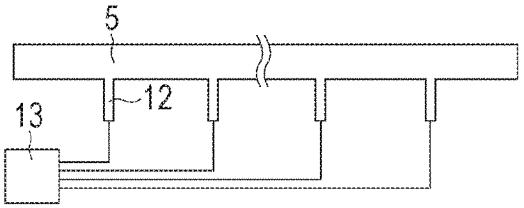

The ink receiving portion 8 has second suction holes 9 and supply ports 10 that are slit and have a long length in the sheet conveyance direction and a short length in the sheet width direction in addition to the suction support portions 6. As illustrated in FIG. 3A, one of the second suction holes 9 and one of the supply ports 10 are formed near the suction support portion 6 in an area of the ink receiving portion 8 through which each sheet 4 passes on the edge side (side edge portion 14 illustrated by a dashed line in the figure) of the sheet 4 in the sheet width direction. Accordingly, the second suction holes 9 and the supply ports 10 are formed in the ink receiving portion 8 beyond the corresponding suction support portions 6 so as to be bilaterally symmetric with respect to the central position C in the sheet width direction of the area through which the sheet 4 passes. The supply ports 10 are located between the corresponding second suction holes 9 and the corresponding suction support portions 6. The second suction holes 9 are in communication with the negative-pressure generating member (not illustrated), and the negative-pressure generating member is operated to suck air downward in the vertical direction. A shared negative-pressure generating source may be used to suck air into the second suction holes 9 and to suck air into the first suction holes 7. As illustrated in FIG. 3B, each supply port 10 is in communication with an air-supplying portion 13 via an air introduction path 12 formed in a lower portion of the platen. The air-supplying portion 13 supplies air to the air introduction path 12 by using a fan or a pump, and the air is supplied upward in the vertical direction through the supply ports 10. As illustrated in FIG. 3A, the second suction hole 9 and the supply port 10 are formed within the area through which the sheet 4 passes. There are no second suction holes 9 nor supply ports 10 around the suction support portions 6S including no first suction holes 7.

Figure 3C:
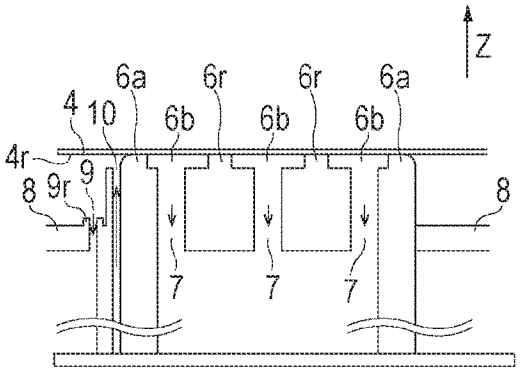

FIG. 3C is a cross-sectional view of the suction support portion 6 and the vicinity thereof taken along line IIIC-IIIC in FIG. 3A. As illustrated in FIG. 3C, the second suction hole 9 is formed at the same height in vertical direction as the ink receiving portion 8 and surrounded by a rib 9*r*. The supply port 10 is formed so as to be higher than the second suction hole 9 in the vertical direction and lower than the contact portion 6*a* of the suction support portion 6. Accordingly, the supply port 10 is formed so as to be closer than the second suction hole 9 to the sheet 4 when the sheet 4 is supported by the suction support portion 6. In the case where the ink absorber (not illustrated) is disposed on the surface of the ink receiving portion 8, the ink absorber is disposed so as not to close the second suction hole 9 and the supply port 10.

The upper limit of the amount of air to be supplied through each supply port 10 is three times the amount of air to be sucked into the corresponding second suction hole 9. The reason is that in the case where the amount of air to be supplied is too larger than the amount of air to be sucked, the sheet 4 cannot adhere to the suction support portions 6 and rises in the vertical direction.

Technical effects that are achieved by the second suction holes 9 and the supply ports 10 that are formed in the ink receiving portion 8 will now be described in detail with reference to a comparative example.

Figure 4A:
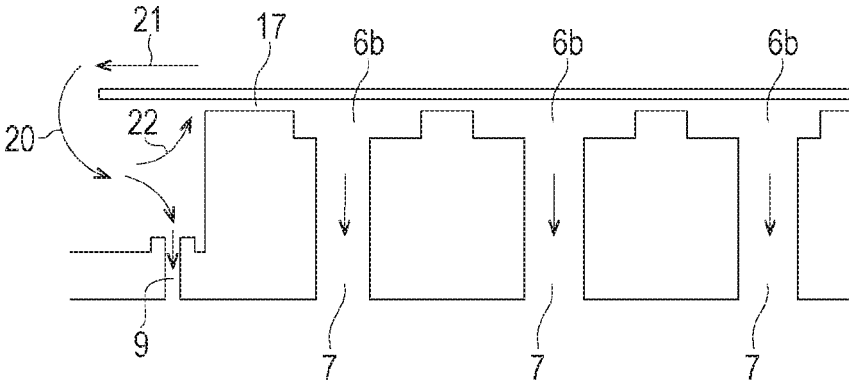
FIG. 4A illustrates a comparative example.
Figure 4B:
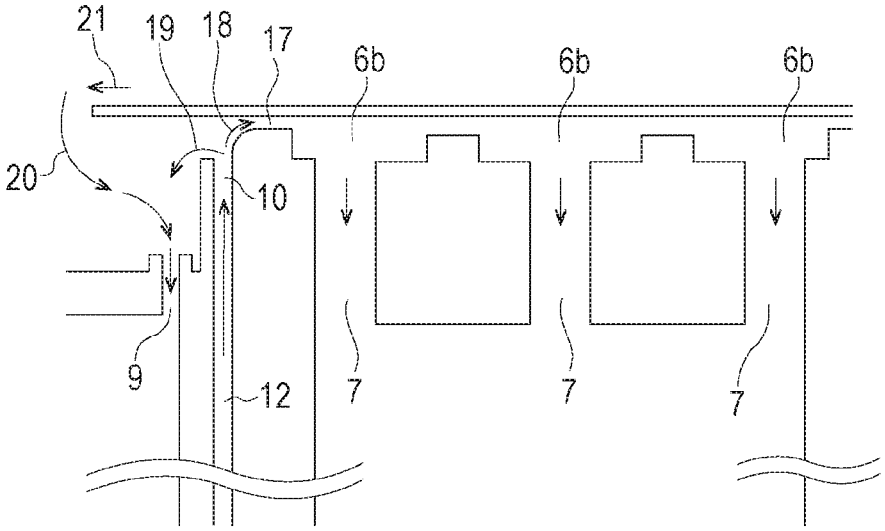
FIG. 4B is a sectional view of the suction support portion according to one or more aspects of the present disclosure and illustrates air flow near the suction support portion.

FIG. 4B is a sectional view of the suction support portion 6 taken along line IV-IV in FIG. 3A and illustrates air flows by arrows when air is sucked into the first suction holes 7 and the second suction hole 9. FIG. 4A illustrates a comparative example in which the ink receiving portion 8 has no supply ports 10. As illustrated in FIG. 4A, when air is sucked into the first suction holes 7, the space defined by the sheet 4 and the non-contact portion 6*b* has a negative pressure lower than the pressure of the surrounding. As illustrated by an air flow 21 in FIG. 4A, continuous suction of air creates an air flow into the space having a negative pressure from the edge or print surface of the sheet 4 via a space 17 between the back surface 4*r* of the sheet 4 and the contact portion 6*a*. In some cases, part of the ink ejected to beyond the sheet 4 becomes an ink mist and the ink mist floats in air over the edge of the sheet 4. Accordingly, each second suction hole 9 is formed to suck air. This enables the ink mist to be sucked and inhibits the ink mist from adhering to the back surface 4*r* of the sheet 4. At this time, most of the ink mist is sucked into the second suction hole 9 (air flow 20) but part of the ink mist flows as an air flow 22 along the back surface 4*r* of the sheet 4 (space 17) and flows into the non-contact portion 6*b* having a negative pressure. This occurs because the space 17 is closer than the second suction hole 9 to the edge of the sheet 4. Accordingly, in some cases, the ink mist cannot be inhibited from adhering to the back surface 4*r* of the sheet 4 even when the second suction holes 9 are formed, and the back surface of the sheet 4 is stained.

FIG. 4B is a diagram illustrating the embodiment and illustrates air flows by arrows in the case where the supply port 10 is formed between the second suction hole 9 and the suction support portion 6, air is sucked into the first suction holes 7 and the second suction hole 9, and air is supplied through the supply port 10. When air is sucked into the first suction holes 7 and the second suction hole 9 in the same manner as the comparative example, the space defined by the sheet 4 and the non-contact portion 6*b* has a negative pressure. At this time, when air is supplied through the supply port 10, the supplied air is separated into an air flow 18 passing through the space 17 toward the space having a negative pressure and an air flow 19 toward the second suction hole 9, into which air is sucked. When air (air flow 21) containing the ink mist flows toward the space 17 as in the comparative example, the air flow 19 created by the air supplied through the supply port 10 obstructs and reduces the air flow 21. Accordingly, the air (air flow 21) containing the ink mist flows as the air flow 20 and is easily collected into the second suction hole 9. Supplying air through the supply port 10 in the above manner enables the ink mist to be efficiently collected in a manner which the air is sucked into the second suction hole 9. Thus, the flow of the ink mist toward the space 17 is prevented, and the back surface of the sheet 4 is inhibited from being stained.

In addition, forming the supply port 10 enables air to be supplied to the second suction hole 9 from the supply port 10 (air flow 19 in FIG. 4B). Accordingly, the air flow 20 from the edge of the sheet 4 toward the second suction hole 9 is reduced. This reduces the air flow 21 created at the edge or on the print surface of the sheet 4. Accordingly, during marginless printing, the ink ejected from the head 3 is inhibited from being blown away by the air flow 21 and inhibited from being out of place at the edge of the sheet 4. Consequently, an ink flow at the edge of the sheet 4 is reduced, and the quality of an image at the edge of the sheet 4 can be improved.

As illustrated in FIG. 3A, the length of the second suction hole 9 and the supply port 10 is the same as the length of each side of the suction support portion 6 in the sheet conveyance direction, and the second suction hole 9 and the supply port 10 are formed so as to overlap the suction support portion 6 in the sheet conveyance direction. In the case where the length of the second suction hole 9 and the supply port 10 is shorter than the length of the side of the suction support portion 6, the air suction and the air supply are not performed along the length of the side of the suction support portion 6, and the above effect cannot be achieved. It is accordingly thought that the back surface of the sheet 4 may be stained due to the ink mist particularly at a location at which the length of the side of the suction support portion 6 is longer than the length of the second suction hole 9 and the supply port 10. The second suction hole 9 and the supply port 10 are formed so as to be parallel to the side of the suction support portion 6 on the edge side of the sheet 4. Accordingly, the air flow created by the second suction hole 9 and the supply port 10 is likely to be uniform along the side of the suction support portion 6, and the adherence of the sheet 4 can be stable. For this reason, it is preferable that the length of the second suction hole 9 and the supply port 10 be the same as the side of the suction support portion 6, and the second suction hole 9 and the supply port 10 be as parallel to the side of the suction support portion 6 as possible. The second suction hole 9 and the supply port 10 are not limited to slits and may be formed of plural elliptical or rectangular holes that are aligned. In the case where the area of the holes is too small, however, the holes are clogged with the ink mist, and the air suction and the air supply are not successfully performed in some cases. Accordingly, the area of the holes is preferably large as in the case of the slits. Specifically, the width of the slits is preferably about 100 μm.

When the platen 5 is viewed from above during printing, the second suction holes 9 and the supply ports 10 are located within the area through which the sheet 4 passes and covered by the sheet 4. The reason is that each supply port 10 needs to be adjacent to the corresponding suction support portion 6 (contact portion 6*a*) in order to supply air through the supply port 10 to the space between the sheet 4 and the non-contact portion 6*b* that has a negative pressure created by the first suction holes 7. In the case where at least one of the second suction holes 9 is located beyond the edge of the sheet 4 when the sheet 4 is supported, air on the edge side of the sheet 4 is sucked from beyond the sheet 4, and accordingly, the air flow 21 along the print surface of the sheet 4 is increased. Thus, the ink flow (position error) is likely to occur at the edge of the sheet during marginless printing, and the quality of an image decreases. In the case where at least one of the second suction holes 9 is located right below the edge of the sheet 4, it is thought that the ink ejected to beyond the sheet 4 may fall, adhere thereto, and close the second suction hole 9. According to the embodiment, these problems are solved in a manner in which the second suction holes 9 are formed outside the corresponding supply ports 10 so as to be adjacent to the corresponding supply ports 10 at positions at which the second suction holes 9 are covered by the sheet 4 when the sheet 4 is supported by the suction support portions 6.

For the purpose of arrangement that facilitates the air supply to each space 17, each supply port 10 is higher than the corresponding second suction hole 9 so as to be close to the back surface 4*r* of the sheet 4 in the vertical direction. Thus, the air flow 18 from the supply port 10 toward the space 17 is likely to occur unlike the comparative example. In the case where each second suction hole 9 is as high as the corresponding supply port 10 in the vertical direction, the distance between the edge of the sheet 4 and the second suction hole 9 is shorter than the distance between the edge of the sheet 4 and the supply port 10, and the air flow 21 along the print surface of the sheet 4 increases. Accordingly, the ink flow is likely to occur at the edge of the sheet 4. For this reason, the second suction holes 9 according to the embodiment are located at the same height as the surface of the ink receiving portion 8 in the vertical direction.

The rib 9*r* surrounds each second suction hole 9. The rib 9*r* inhibits the ink ejected to beyond the sheet 4 during marginless printing from flowing into the second suction hole 9 when the ink is collected in the ink receiving portion 8 and the ink receiving portion 8 no longer receives the ink. Even in the case where the ink receiving portion 8 includes the ink absorber (not illustrated), there is a possibility that the ink that cannot be absorbed by the ink absorber flows into the second suction hole 9. The rib 9*r* inhibits the ink from flowing into the corresponding second suction hole 9.

The second suction holes 9 share the negative-pressure generating member (not illustrated) with the first suction holes 7. Accordingly, the number of components such as a duct can be reduced to reduce the cost, and space-saving can be achieved. The air-supplying portion 13 supplies air outside the image printing apparatus 1 to the supply ports 10, and accordingly, the air containing no ink mist can be supplied through the supply ports 10.

Figure 3D:
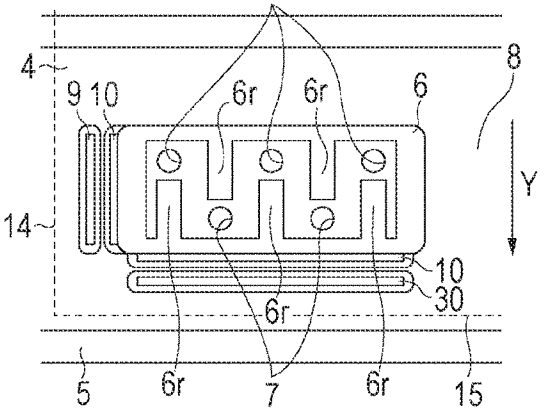
Figure 3E:
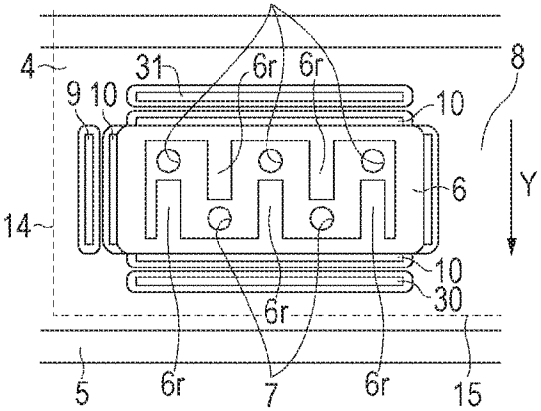
Figure 3F:
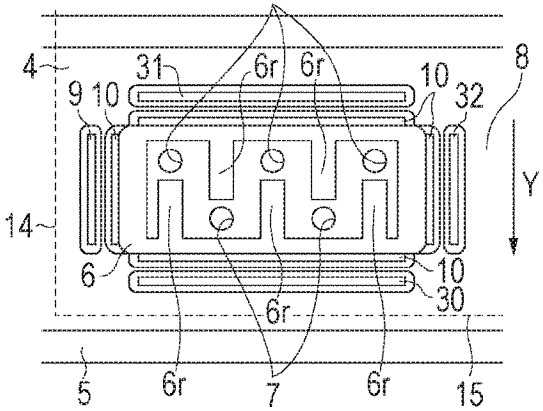

Modifications to the embodiment will now be described with reference to FIGS. 3D to 3F. In FIG. 3D, a third suction hole (an upstream suction hole) 30 is additionally formed upstream of the suction support portion 6 in the sheet conveyance direction, and a second supply port 10 is formed between the third suction hole 30 and the suction support portion 6. Thus, when marginless printing is performed on the leading end portion 15 of the sheet 4, the back surface of the sheet 4 can be inhibited from being stained. In FIG. 3E, a fourth suction hole (an inner suction hole) 31 is additionally formed downstream of the suction support portion 6 in the sheet conveyance direction, and a third supply port 10 is formed between the fourth suction hole 31 and the suction support portion 6, in addition to the third suction hole 30 and the second supply port 10. Thus, when marginless printing is performed on the trailing end portion (not illustrated) of the sheet 4, the sheet 4 can be inhibited from being stained. In FIG. 3F, a fifth suction hole 32 is additionally formed on the inner side of the suction support portion 6 in the sheet width direction, and a fourth supply port 10 is formed between the fifth suction hole 32 and the suction support portion 6, in addition to the third suction hole 30, the fourth suction hole 31, and the second and third supply ports 10. The third suction hole 30, the fourth suction hole 31, and the fifth suction hole 32 are in communication with the negative-pressure generating member, and air is sucked into these suction holes downward in the vertical direction as in the case of the second suction hole 9. In FIG. 3F, the suction holes and the supply ports 10 are formed along the respective four sides of the suction support portion 6. Thus, the sheet 4 can stably adhere to each suction support portion 6.

Second Embodiment

Figure 5A:
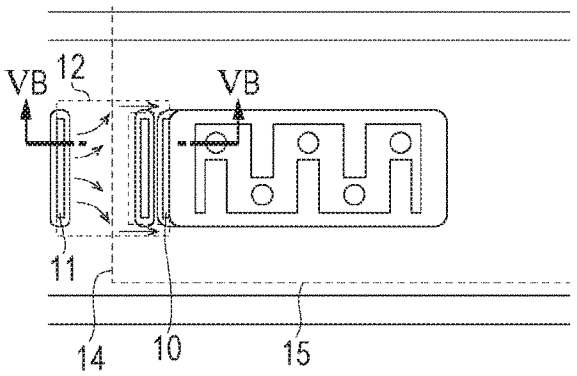
FIGS. 5A to 5E are schematic views of a suction support portion according to one or more aspects of the present disclosure and the vicinity thereof.

FIGS. 5A to 5E are enlarged views of a suction support portion 6 according to a second embodiment and the vicinity thereof. FIG. 5A is a top view thereof. FIGS. 5A to 5E illustrate the suction support portion 6L by way of example. In particular, FIGS. 5A to 5E each illustrate a state where the sheet 4 is conveyed to the printing position when an image is printed on the leading end portion 15 and one of the side edge portions 14 of the sheet 4. The suction support portion 6L illustrated includes five first suction holes 7 and five intermediate ribs 6*r*. The basic structure of the apparatus is the same as in the first embodiment, and components having the same function are designated by like symbols.

According to the second embodiment, as illustrated in FIG. 5A, an intake port 11 in which air to be supplied to the supply port 10 is taken is formed in a surface layer of the ink receiving portion 8. The intake port 11 is elongated and extends in the sheet conveyance direction and is formed in each suction support portion 6 outside the second suction hole 9 with respect to the central position C in the sheet width direction of the area through which the sheet 4 passes.

Figure 5B:
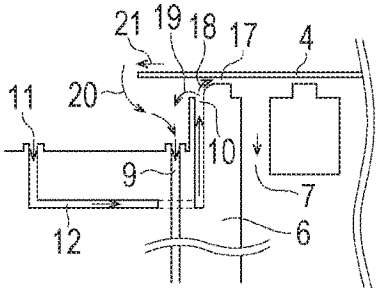

FIG. 5B is a sectional view of the suction support portion 6 and the vicinity thereof taken along line VB-VB in FIG. 5A. According to the second embodiment, as illustrated in FIG. 5B, for the purpose of the communication between the supply port 10 and the intake port 11, the air introduction path 12 (channel) is formed in a lower portion (back-surface layer of the platen 5) of the ink receiving portion 8 in the vertical direction. The second suction hole 9 is formed between the intake port 11 and the supply port 10, and accordingly, the air introduction path 12 is formed so as to pass through the side upstream of the second suction hole 9 and the side downstream of the second suction hole 9 in the sheet conveyance direction.

In the first embodiment, air is supplied from the air-supplying portion 13 to each supply port 10. In the second embodiment, air is taken in each intake port 11 away from the corresponding supply port 10 and supplied to the supply port 10 via the corresponding air introduction path 12. The intake port 11 is formed at a portion that is not covered by the sheet 4 beyond the area through which the sheet 4 passes. Accordingly, the intake port 11 is not closed by the sheet 4, and air can be successfully taken in.

Each intake port 11 is surrounded by a rib 11*r* as in the case of the second suction holes 9. The rib 11*r* inhibits the ink ejected to beyond the sheet 4 during marginless printing from flowing into the corresponding intake port 11 when the ink is collected in the ink receiving portion 8 and the ink receiving portion 8 no longer receives the ink. Even in the case where the ink receiving portion 8 includes the ink absorber (not illustrated), there is a possibility that the ink that cannot be absorbed by the ink absorber flows into the intake port 11. The rib 11*r* inhibits the ink from flowing into the corresponding intake port 11.

When air is sucked into the first suction holes 7, the space 17 between the sheet 4 and the contact portion 6*a* has a negative pressure lower than the pressure of the surrounding as in the first embodiment. Air is sucked not only into the first suction holes 7 but also into the second suction holes 9, and accordingly, each supply port 10 between the corresponding second suction hole 9 and space 17 has a pressure lower than the pressure of the corresponding intake port 11, which is not covered by the sheet 4. When the difference in the pressure is thus made between each supply port 10 and the corresponding intake port 11, air is supplied from the intake port 11 to the supply port 10 via the air introduction path 12, and the air is supplied through the supply port 10 toward the back surface 4*r* of the sheet 4. Accordingly, the air flow 19 created from the supply port 10 reduces the air flow from the edge of the sheet 4 to the space 17 as in the first embodiment. At this time, the air taken in the intake port 11 contains no ink mist because the intake port 11 is separated from the side edge portion of the sheet 4. Thus, the back surface of the sheet 4 can be inhibited from being stained due to the ink mist.

Air is supplied through each supply port 10 to the corresponding second suction hole 9, into which the air is sucked, and accordingly, the air flow 21 from the edge of the sheet 4 toward the second suction hole 9 is reduced as in the first embodiment. For this reason, also in the second embodiment, the ink can be inhibited from being out of place at the edge of the sheet 4 during marginless printing. In the first embodiment, the air-supplying portion 13 supplies air. In the second embodiment, the difference in the pressure is used to supply air, and accordingly, the space-saving can be achieved more than in the first embodiment, and the number of the components can be reduced to reduce the cost.

Figure 5C:
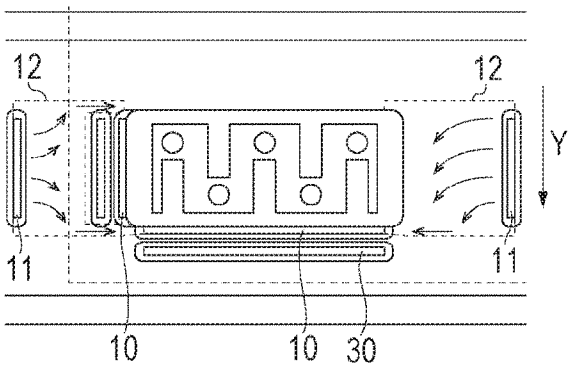
Figure 5D:
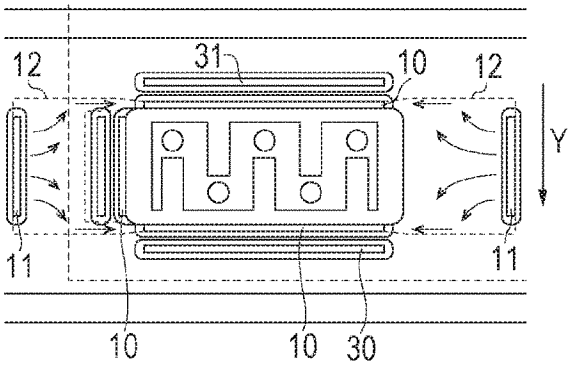
Figure 5E:
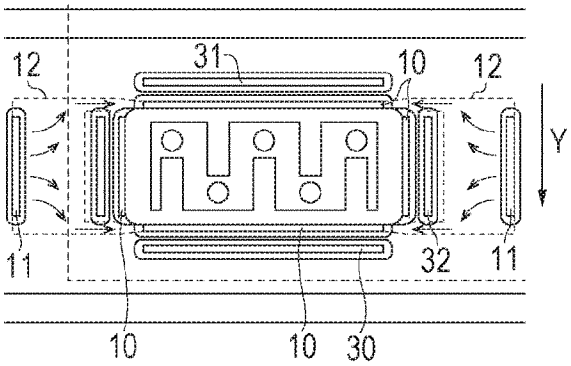

FIGS. 5C to 5E are top views of modifications to the second embodiment. In FIG. 5C, the third suction hole 30 is additionally formed upstream of the suction support portion 6 in the sheet conveyance direction, and the second supply port 10 is formed between the third suction hole 30 and the suction support portion 6. A second intake port 11 is formed in the area through which the sheet 4 passes so as to be opposite to the intake port 11 in FIG. 5A with the suction support portion 6 interposed therebetween in the sheet width direction. Accordingly, air is supplied from the two intake ports 11 to the two supply ports 10. Thus, the back surface of the sheet 4 can be inhibited from being stained when marginless printing is performed on the leading end portion 15 of the sheet 4. In FIG. 5D, the fourth suction hole 31 is additionally formed downstream of the suction support portion 6 in the sheet conveyance direction, and the third supply port 10 is formed between the fourth suction hole 31 and the suction support portion 6, in addition to the third suction hole 30 and the second supply port 10. Thus, when marginless printing is performed on the trailing end portion (not illustrated) of the sheet 4, the sheet 4 can be inhibited from being stained. In FIG. 5E, the fifth suction hole 32 is additionally formed on the inner side of the suction support portion 6 in the sheet width direction, and the fourth supply port 10 is formed between the fifth suction hole 32 and the suction support portion 6, in addition to the third suction hole 30, the fourth suction hole 31, and the second and third supply ports 10. Thus, the sheet 4 can stably adhere to each suction support portion 6. In the second embodiment, the number of the intake ports 11 is described by way of example and preferably determined appropriately in accordance with the number of the second suction holes 9 and the supply ports 10.

Third Embodiment

Figure 6C:
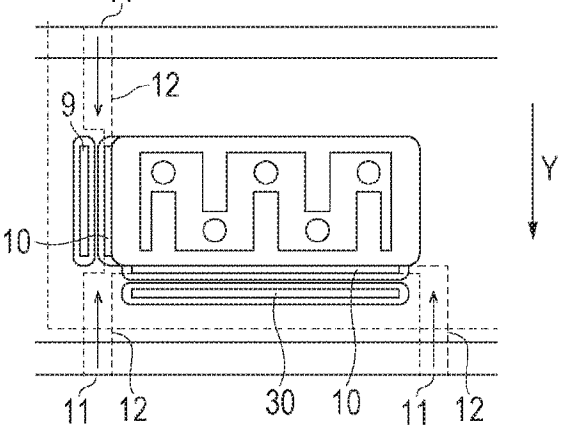
FIGS. 6A to 6E are schematic views of a suction support portion according to one or more aspects of the present disclosure and the vicinity thereof.
Figure 6B:
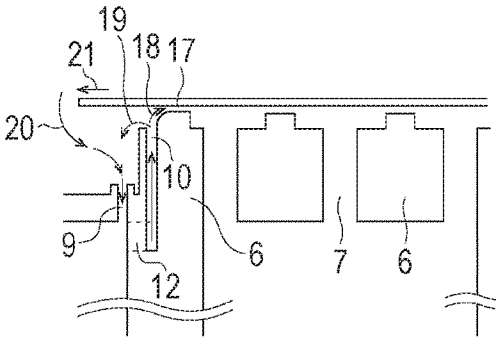
Figure 6A:
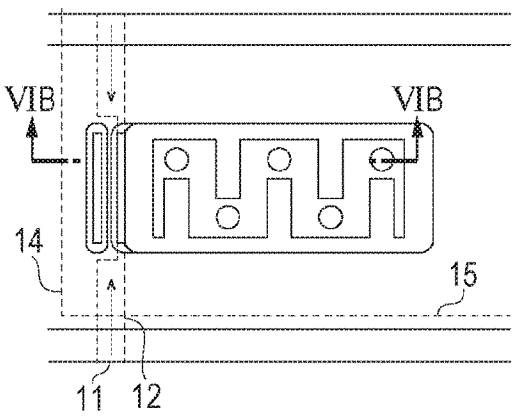

FIGS. 6A to 6E are enlarged views of a suction support portion 6 according to a third embodiment and the vicinity thereof. FIG. 6A is a top view thereof. FIGS. 6A to 6E illustrate the suction support portion 6L by way of example. In particular, FIGS. 6A to 6E each illustrate a state where the sheet 4 is conveyed to the printing position when an image is printed on the leading end portion 15 and one of the side edge portions 14 of the sheet 4. The suction support portion 6L illustrated includes five first suction holes 7 and five intermediate ribs 6*r*. The basic structure of the apparatus is the same as in the first embodiment, and components having the same function are designated by like symbols.

According to the third embodiment, as illustrated in FIG. 6A, the intake ports 11 are formed in both of the edge portions of the platen 5 on the upstream and downstream sides in the sheet conveyance direction. That is, one of the intake ports 11 is formed below the upstream support portion 40 in the vertical direction, and the other is formed below the downstream support portion 41 in the vertical direction. FIG. 6B is a sectional view of the suction support portion 6 taken along line VIB-VIB in FIG. 6A. For the purpose of the communication between the supply port 10 and the intake ports 11, the air introduction paths 12 extending in the sheet conveyance direction are formed in a lower portion (back-surface layer of the platen 5) of the ink receiving portion 8 in the vertical direction as in the second embodiment.

In the third embodiment, the difference in the pressure between each supply port 10 and the corresponding intake port 11 is used to supply air from the intake port 11 to the supply port 10. Consequently, the air flow 18 from the supply port 10 toward the space 17 reduces the air flow from the edge of the sheet 4 to the space 17, and the back surface of the sheet 4 can be inhibited from being stained due to the ink mist as in the first embodiment and the second embodiment. Air is supplied from each supply port 10 to the corresponding second suction hole 9, into which the air is sucked, and accordingly, the air flow 21 from the edge of the sheet 4 toward the second suction hole 9 is reduced, and the ink flow at the side edge portion of the sheet 4 can be inhibited during marginless printing.

The difference in the pressure between each supply port 10 and the corresponding intake port 11 is used to supply air as in the second embodiment, the air-supplying portion is not necessary unlike the first embodiment, and accordingly, the space-saving can be achieved. In addition, the number of the components can be reduced to reduce the cost.

Figure 6E:
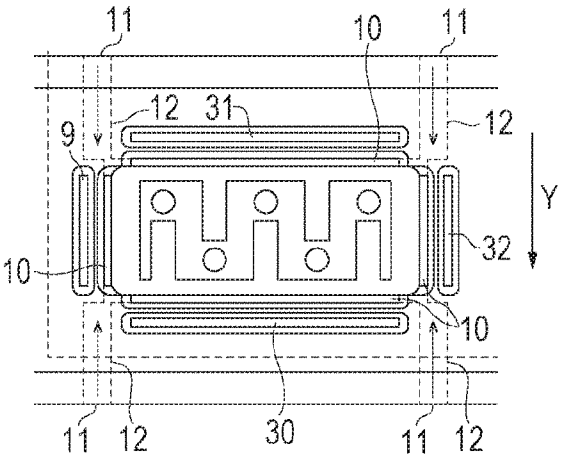
Figure 6D:
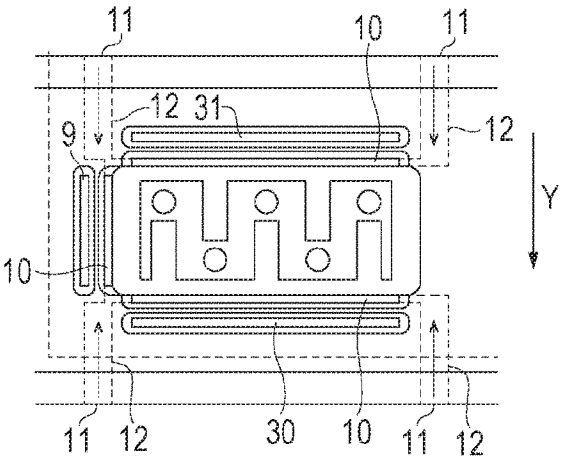

FIGS. 6C to 6E are top views of modifications to the third embodiment. In FIG. 6C, the third suction hole 30 is additionally formed upstream of the suction support portion 6 in the sheet conveyance direction, and the second supply port 10 is formed between the third suction hole 30 and the suction support portion 6. Another intake port 11 is additionally formed upstream of the suction support portion 6 in the sheet conveyance direction. Accordingly, air is supplied from the three intake ports 11 to the two supply ports 10. Thus, the back surface of the sheet 4 can be inhibited from being stained when marginless printing is performed on the leading end portion 15 of the sheet 4. In FIG. 6D, the fourth suction hole 31 is additionally formed downstream of the suction support portion 6 in the sheet conveyance direction, and the third supply port 10 is formed between the fourth suction hole 31 and the suction support portion 6, in addition to the third suction hole 30 and the second supply port 10. Another intake port 11 is additionally formed downstream of the suction support portion 6 in the sheet conveyance direction. Accordingly, air is supplied from the four intake ports 11 to the three supply ports 10. Thus, when marginless printing is performed on the trailing end portion (not illustrated) of the sheet 4, the sheet 4 can be inhibited from being stained. In FIG. 6E, the fifth suction hole 32 is additionally formed on the inner side of the suction support portion 6 in the sheet width direction, and the fourth supply port 10 is formed between the fifth suction hole 32 and the suction support portion 6, in addition to the third suction hole 30, the fourth suction hole 31, and the second and third supply ports 10. Thus, the sheet 4 can stably adhere to each suction support portion 6. The intake ports 11 are not necessarily formed in both of the edge portions of the platen 5 on the upstream and downstream sides in the sheet conveyance direction and may be formed on one side. In the case where the number of the intake ports 11 is adjusted, the number is preferably changed in accordance with the length of the corresponding suction support portion 6 such that air is sufficiently supplied to a central portion of each supply port 10. Also, the number of the intake ports 11 is preferably adjusted in accordance with the number of the second suction holes 9 and the supply ports 10 as in the second embodiment.

Fourth Embodiment

Figure 7A:
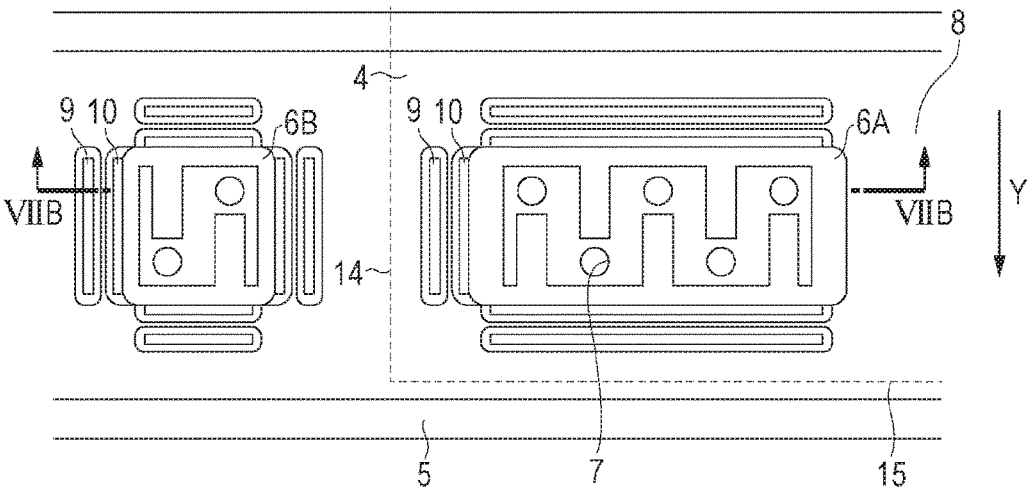
FIGS. 7A and 7B are schematic views of suction support portions according to one or more aspects of the present disclosure and the vicinity thereof.
Figure 7B:
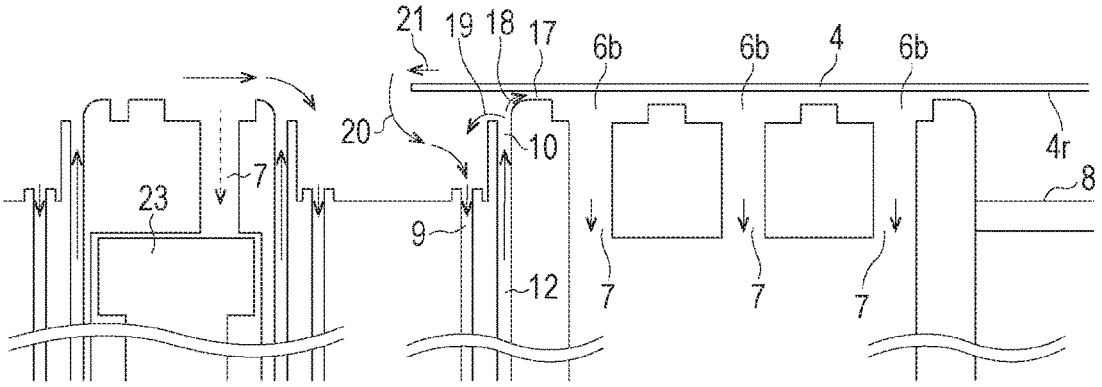

According to a fourth embodiment, when the sheet 4 having a certain width adheres to the platen 5, the air suction by the suction support portion 6 that is not covered by the sheet 4 is stopped. FIGS. 7A and 7B are enlarged views of the suction support portions 6 according to the fourth embodiment and the vicinity thereof. FIG. 7A is a top view thereof. The two suction support portions 6 illustrated in FIGS. 7A and 7B correspond to the suction support portions 6L each including the first suction holes 7 and the intermediate ribs 6*r*. In FIG. 7A, one of the side edge portions 14 and leading end portion 15 of the sheet 4 are illustrated by dashed lines, and the sheet 4 covers a suction support portion 6A on the right side in the figure. In the fourth embodiment, the air suction by a suction support portion 6B on the left side in the figure, through which the sheet 4 does not pass, is stopped. The basic structure of the apparatus is the same as in the first embodiment, and components having the same function are designated by like symbols.

A switching valve (a switching unit) 23 serving as a unit that stops the air suction by the suction support portion 6B is disposed in a lower portion of the suction support portion 6B in the vertical direction. The switching valve 23 switches a state of the corresponding first suction hole 7 between a communication state in which the first suction hole 7 opens and a non-communication state in which the first suction hole 7 closes. The switching valve 23 is disposed in each suction support portion 6, and the air suction is controlled individually in each suction support portion 6 in accordance with the width of the sheet. The control is performed in a manner in which a signal of the size of the sheet that is specified by a user for the image printing apparatus 1 is received, and the corresponding switching valve 23 moves in the vertical direction. When the switching valve 23 moves upward in the vertical direction, the corresponding first suction hole 7 closes and is in the non-communication state. When the switching valve 23 moves downward in the vertical direction, the corresponding first suction hole 7 opens and is in the communication state. The switching valve 23 stops the air suction into the corresponding first suction hole 7. Air is sucked into the second suction holes 9, and the air is supplied through the supply ports 10.

FIG. 7B is a sectional view of the suction support portions 6 of the platen 5 and the vicinity thereof taken along line VIIB-VIIB in FIG. 7A and illustrates air flows when the switching valve 23 closes the first suction hole 7 of the suction support portion 6B. As illustrated in FIG. 7B, when the first suction hole 7 closes, the air suction into the suction support portion 6B reduces, and the air flow from the edge of the sheet 4 toward the suction support portion 6B reduces. This reduces the air flow 21 along the sheet 4 supported by the suction support portion 6A and inhibits the ink applied to the edge of the sheet 4 from being out of place. Thus, the quality of an image at the edge of the sheet 4 can be improved. The smaller the size of the sheet 4, the smaller the area through which the sheet 4 passes. Accordingly, locations at which air is sucked reduces, and the power consumption of the negative-pressure generating member decreases.

That is, according to the present disclosure, an image printing apparatus that enables marginless printing with high quality of an image at the edge of a recording medium can be provided.

While the present disclosure has been described with reference to exemplary embodiments, the scope of the following claims is to be accorded the broadest interpretation so as to encompass all such modifications and equivalent structures and functions.

This application claims the benefit of Japanese Patent Application No. 2016-048861 filed Mar. 11, 2016, which is hereby incorporated by reference herein in its entirety.

What is claimed is:

1. An image printing apparatus, comprising:

a printing head that ejects an ink to perform printing;

a platen that supports a recording medium at a position at which the platen faces the printing head;

an ink receiving portion that is formed on the platen and receives the ink ejected to beyond an edge of the recording medium during printing;

a first support portion that is disposed on the platen upstream of the ink receiving portion in a conveyance direction of the recording medium and supports the recording medium;

a second support portion that is disposed on the platen downstream of the ink receiving portion in the conveyance direction and supports the recording medium; and a third support portion that is disposed on the platen near an edge of the recording medium in a width direction of the recording medium in an area through which the recording medium passes, wherein the third support portion includes a contact portion that protrudes from the ink receiving portion and comes into contact with the recording medium, a non-contact portion that is surrounded by the contact portion and does not come into contact with the recording medium, and a first suction hole formed in the non-contact portion, and air is sucked into the first suction hole to cause the recording medium to adhere to the contact portion, and wherein the ink receiving portion has a second suction hole formed in the area through which the recording medium passes at least beyond the third support portion in the width direction or downstream of the third support portion in the conveyance direction and a supply port formed between the third support portion and the second suction hole, and air is sucked into the second suction hole and supplied toward the recording medium through the supply port.

2. The image printing apparatus according to claim 1, wherein a plurality of the third support portions are arranged in the width direction so as to correspond to different sizes of the recording medium.

3. The image printing apparatus according to claim 1, wherein the second suction hole is surrounded by a rib.

4. The image printing apparatus according to claim 1, wherein the supply port is in communication with an intake port in which air is taken from beyond the area through which the recording medium supported by the third support portion passes.

5. The image printing apparatus according to claim 4, wherein the intake port is formed in the ink receiving portion, and a channel connecting the supply port and the intake port to each other is formed in a back-surface layer of the platen.

6. The image printing apparatus according to claim 4, wherein the intake port is formed below the first support portion in a vertical direction, and a channel connecting the supply port and the intake port to each other is formed in a back-surface layer of the platen.

7. The image printing apparatus according to claim 4, wherein the intake port is formed below the second support portion in a vertical direction, and a channel connecting the supply port and the intake port to each other is formed in a back-surface layer of the platen.

8. The image printing apparatus according to claim 4, wherein a plurality of the intake ports are formed below the first support portion in a vertical direction and below the second support portion in the vertical direction, and channels connecting the supply port and the intake ports to each other are formed in a back-surface layer of the platen.

9. The image printing apparatus according to claim 1, further comprising:

a switching unit that switches a state of the first suction hole between a communication state in which the first suction hole opens and a non-communication state in which the first suction hole closes.

10. The image printing apparatus according to claim 9, wherein the state of the first suction hole located beyond the area through which the recording medium passes is switched to the non-communication state by the switching unit.

11. The image printing apparatus according to claim 1, wherein the ink receiving portion has an upstream suction hole formed upstream of the third support portion in the conveyance direction in the area through which the recording medium passes and a second supply port formed between the third support portion and the upstream suction hole, and air is sucked into the upstream suction hole and supplied toward the recording medium through the second supply port.

12. The image printing apparatus according to claim 1, wherein the ink receiving portion has an inner suction hole formed on an inner side of the third support portion in the width direction in the area through which the recording medium passes and a third supply port formed between the third support portion and the inner suction hole, and air is sucked into the inner suction hole and supplied toward the recording medium through the third supply port.

* * * * *